US009486043B2

(12) United States Patent
Rydlewicz

(10) Patent No.: US 9,486,043 B2
(45) Date of Patent: Nov. 8, 2016

(54) HEXAGON SHAPED DIAMOND WHICH DISPLAYS HEARTS AND ARROWS PATTERN

(75) Inventor: Roni Rydlewicz, Brussels (BE)

(73) Assignee: WORLDWIDE DIAMOND TRADEMARKS LTD.CA (US)

( * ) Notice: Subject to any disclaimer, the term of this patent is extended or adjusted under 35 U.S.C. 154(b) by 1602 days.

(21) Appl. No.: 11/744,571

(22) Filed: May 4, 2007

(65) Prior Publication Data

US 2008/0271486 A1 Nov. 6, 2008

(51) Int. Cl.
*A44C 17/00* (2006.01)

(52) U.S. Cl.
CPC ..... *A44C 17/001* (2013.01)

(58) Field of Classification Search
None
See application file for complete search history.

(56) References Cited

U.S. PATENT DOCUMENTS

| | | | | |
|---|---|---|---|---|
| D469,379 | S * | 1/2003 | Siebenberg | D11/90 |
| D511,989 | S * | 11/2005 | Pereira De Castro et al. | D11/90 |
| D521,409 | S * | 5/2006 | De Castro et al. | D11/90 |
| D567,138 | S * | 4/2008 | Rydlewicz | D11/90 |
| 2003/0221452 | A1 * | 12/2003 | Morbidoni | 63/26 |

* cited by examiner

*Primary Examiner* — Jack W Lavinder
(74) *Attorney, Agent, or Firm* — Bakerhostetler LLP

(57) ABSTRACT

A hexagonal shaped diamond, adapted to display a hearts and arrows pattern when exposed to light comparable to the hearts and arrows pattern in a round diamond. The hexagon shaped diamond should be cut to form six main crown facets of substantially equal size symmetrically arranged relative to one another surrounding a table facet with each main crown facet having parallel edges symmetrically aligned to the parallel edges of a main crown facet located opposite thereto, six main pavilion facets polished in alignment with the main crown facets, girdle facets separating the pavilion facets from the main crown facets and twelve crown star facets.

7 Claims, 9 Drawing Sheets

8
6
chf
mcf
csf
chf
mcf
csf
chf
mcf
csf

HEXAGON SHAPED DIAMOND WHICH DISPLAYS HEARTS AND ARROWS PATTERN

FIELD OF THE INVENTION

The present invention relates to the field of cut diamonds and more particularly to a diamond cut in the shape of a hexagon and adapted to generate a hearts and arrows pattern substantially comparable to the hearts and arrows pattern generated by an ideal round cut diamond when exposed to light.

BACKGROUND OF THE INVENTION

A hearts and arrows pattern is successfully generated from within a round cut diamond when exposed to light, provided that the round diamond has a nearly perfect symmetrically round shape possessing equal and symmetrically cut facets polished within relatively narrow proportional ranges, as taught below in Table I. A near perfect round cut diamond having a hearts and arrows pattern provides brilliance, color and optical light handling properties which has not been matched in the marketplace by any other shaped diamond to date. Although diamonds are typically cut into many known geometrical shapes other than round such as, for example, a heart shape, oval, pear, marquis, princess, emerald, etc., it is currently unknown to cut a diamond into a hexagonal shape much less in a manner to yield a hearts and arrows pattern substantially comparable to the hearts and arrows pattern generated by an ideal round cut diamond when exposed to light.

It is widely believed in the diamond industry that only the round cut diamond can generate a true hearts and arrows pattern. This belief is primarily based upon the fact that the round cut diamond has such a nearly perfect symmetrical shape and that all of its crown and pavilion facets can be readily cut to the same angle degrees with the angle differences between all of its pavilion angles being smaller than 0.3°, and with the angle tolerance between the main crown facets being smaller than 0.4° and the angle tolerance for the subsidiary crown facets being smaller than 0.3°. This rational lies has led to the widely accepted belief in the diamond industry that it is not possible to obtain a true hearts and arrows pattern on any shape which is not polished to simulate the nearly perfect symmetrical shape of a round shape and to satisfy the narrow angular tolerances known to yield a hearts and arrows pattern in a round cut diamond.

A hexagon shaped diamond has a geometrical shape which is clearly quite different in angular geometry from that of a round diamond and in fact, to date, it is currently unknown to cut a diamond into a hexagon shape. Moreover it is clearly unknown how one would create a hearts and arrows pattern in a hexagon shaped diamond particularly if one accepts the widely accepted belief in the diamond industry that the diamond should be cut to satisfy the narrow angular tolerances known to yield a hearts and arrows pattern in a round cut diamond.

In a round cut diamond, the hearts and arrows pattern appears only when the requirements for its cut facets, angle parameters and alignment relationships are as shown in the following Table 1:

TABLE 1

| |
|---|
| The shape of the diamond is perfectly symmetrical |
| 8 main crown and 24 subsidiary crown facets |
| 8 main bottom and 16 subsidiary bottom facets |
| All main facets (crown & bottom) have to be polished at a perfect 45° angle to each other |
| All facets are perfectly aligned |
| All the bottom main facets are of equal size and at an angle ranging from 40.6°-41.0° |
| All the bottom subsidiary facets are of equal size and at an angle which is exactly 1.2° steeper than the main facets (main bottom angle 40.6°-41.0° + subsidiary 41.8°-42.2°) |
| All the main crown facets are of equal size and at an angle ranging from 33.8°-35.1°. They have to be perfectly aligned on the main bottom facets. |
| All the subsidiary crown facets are of equal size and perfectly aligned on the main crown and subsidiary bottom facets and polished at an equal angle. |
| The ideal cut proportions are: total depth 59.4%-62.4%<br>crown height 14.5%-16.0%<br>girdle thickness 1.5%-2.95%<br>Roundness 99.0%-100%<br>Table size: 53.0%-57.5% |

SUMMARY OF THE INVENTION

The diamond of the present invention possesses the shape of a hexagon and displays a hearts and arrows pattern characteristic substantially equivalent to the hearts and arrows pattern displayed in a round diamond when exposed to light. The hexagonal shaped diamond of the present invention comprises: six main crown facets arranged relative to one another so that each main crown facet has a symmetrically aligned parallel opposite facet surrounding a table facet, six main pavilion facets, girdle facets for separating the main crown facets from the pavilion facets and twelve crown star facets. In accordance with the present invention a hexagonally shaped diamond may be cut to yield a hearts and arrows pattern characteristic which will be substantially equivalent to the hearts and arrows pattern displayed in a round cut diamond provided each of the main crown facets has two of the crown star facets polished thereon and that the girdle facets are polished into six girdle facets of equal size with each disposed at an angle of 60° relative to each adjacent girdle facet. The hexagonal shaped diamond of the present invention should also preferably include twelve crown halve facets and twelve pavilion halve facets. Subsidiary pavilion facets may optionally be included particularly when the rough diamond used to for the hexagonal shape is thick. In such case the preferred number of subsidiary pavilion facets is six.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

A diamond is a crystal which functions as a prism for dispersing light by means of reflection and refraction. The diamond of the present invention 10 as shown in FIGS. 1-9 possesses a hexagonal shape having six main crown facets ("mcf's") of equal size, with each main crown facet mcf being aligned opposite another main crown mcf facet in a symmetrical arrangement surrounding a table facet ("tf"), six main pavilion facets ("mpf's"), girdle facets ("gf's") for separating the main crown facets from the pavilion facets and twelve crown star facets ("csf's"). The girdle facets gf's are polished first into six equal size girdle facets gf's to give the diamond a hexagonal shaped geometry, two of which are shown in the side view of FIG. 3 before the main crown facets mcf's are polished. Each main crown facet mcf should have two straight edges 2 and 4 which lie in parallel alignment to one another and in parallel alignment with the straight edges 2 and 4 of an oppositely aligned main crown facet mcf. The twelve crown star facets csf's are polished in an arrangement with two crown star facets csf's on each main crown facet mcf. Preferably each girdle facet gf should be polished to form an angle of 60° relative to the girdle facet gf on each adjacent side thereof as evident from FIG. 4. The main crown facets mcf's are preferably polished to within a degree range of between 33.8°-35.2° so that they are equal in size as well as being equal in depth and within an angle tolerance of 0.4°.

Figure 1:
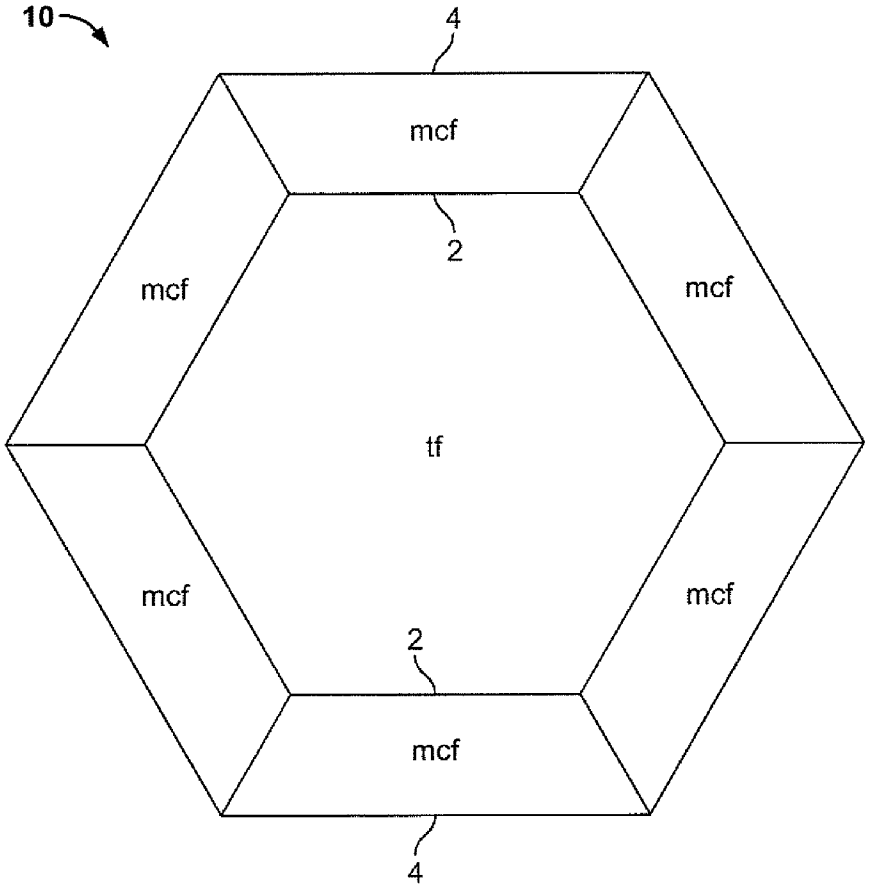
FIG. 1 is a top view of the hexagonal shaped diamond of the present invention showing a symmetrical arrangement of the six main crown facets on the table facet side.
Figure 2:
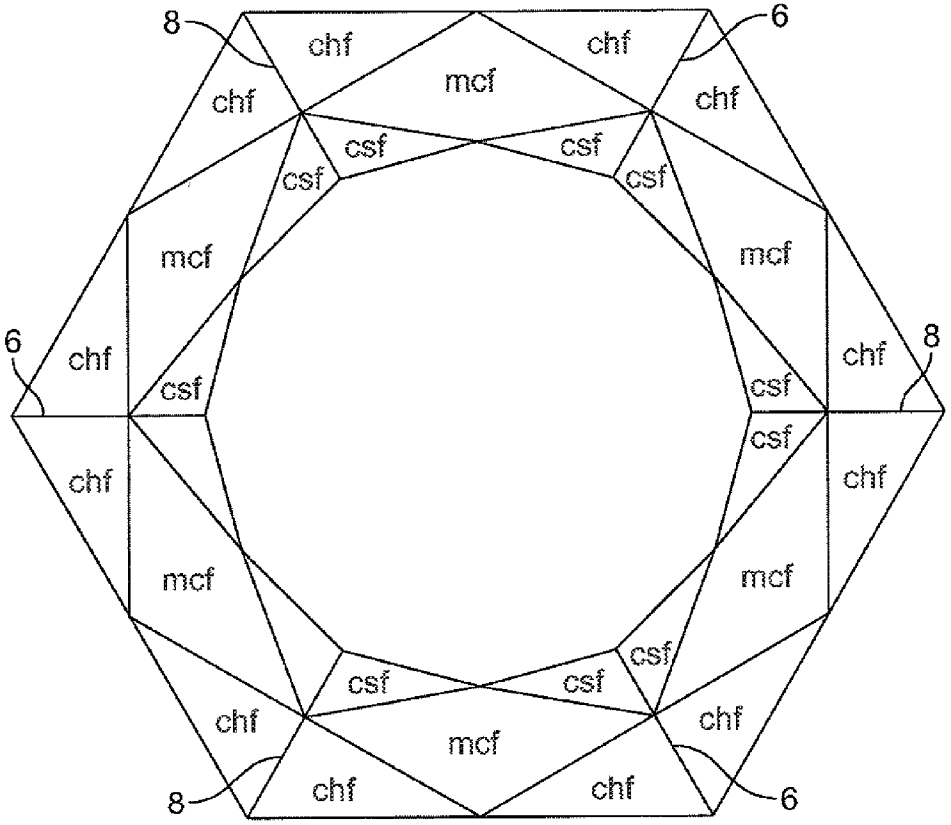
FIG. 2 is another top view of the hexagonal shaped diamond of the present invention similar to FIG. 1 showing the formation and arrangement of the main crown facets relative to the formation and arrangement of crown half facets and crown star facets.
Figure 3:
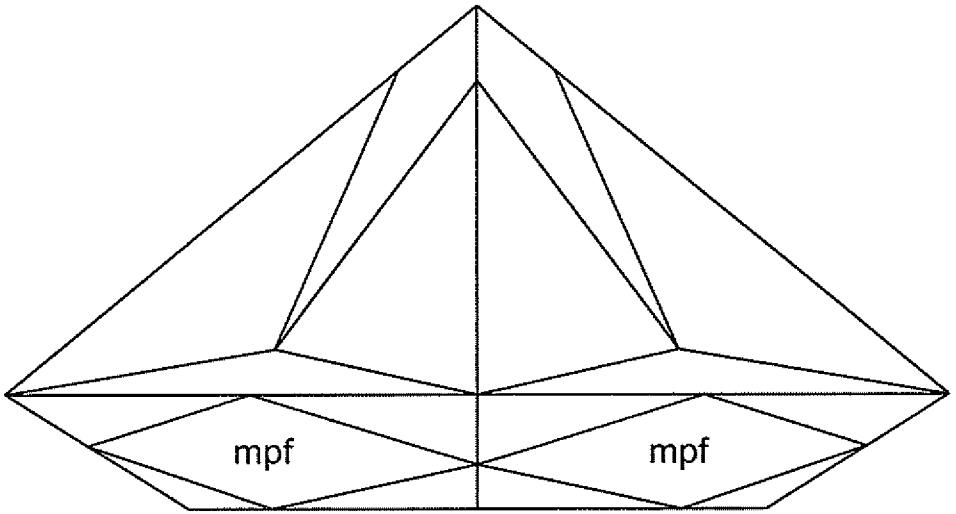
FIG. 3 is a side profile view of the hexagonal shaped diamond of the present invention showing the girdle facets separating the crown facets on the table facet side of the diamond from the pavilion facets.
Figure 4:
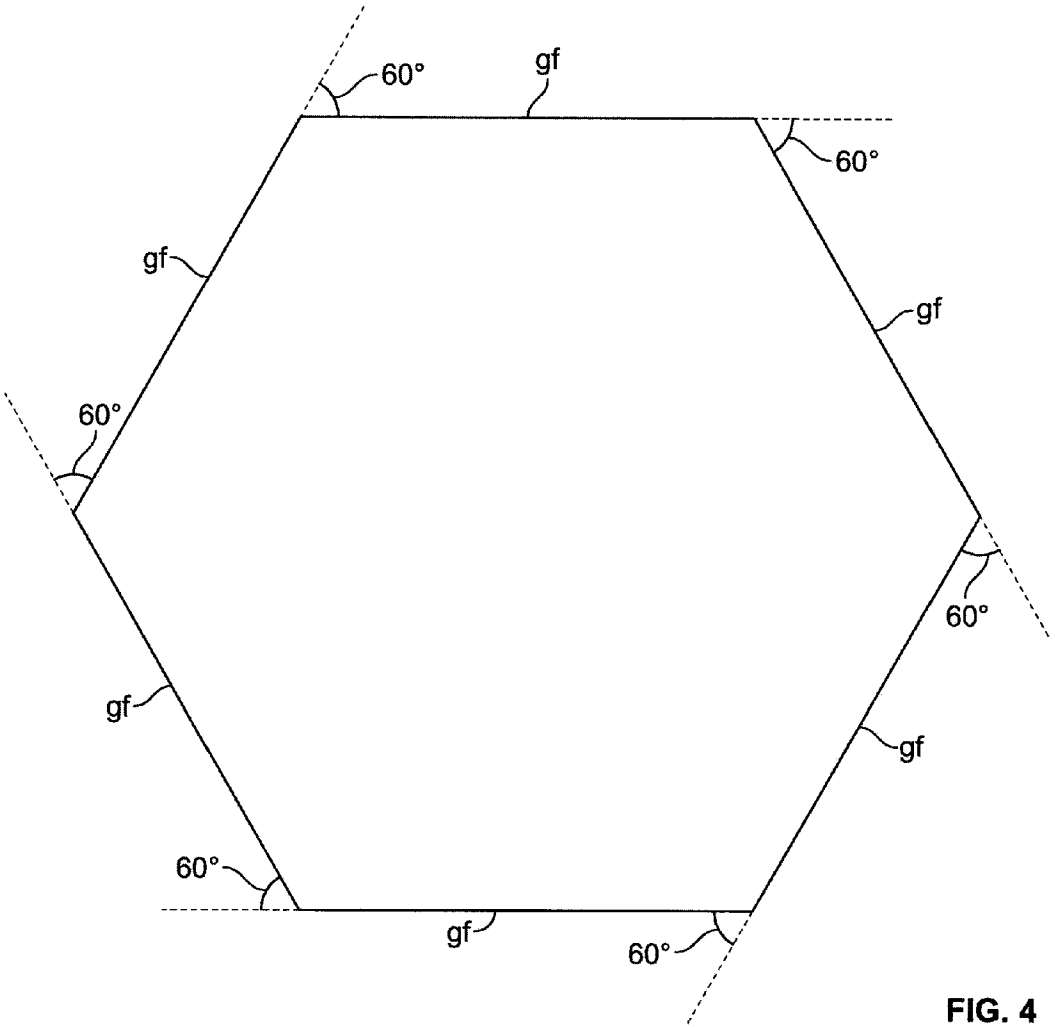
FIG. 4 is a top view of the hexagonal shaped diamond of the present invention illustrating the angular relationship of the girdle facets.

The hexagon shaped diamond 10 should also include twelve crown half facets ("chf's"). In the preferred arrangement two of the crown star facets csf's and two of the crown half facets chf's are polished on each main crown facet mcf as is shown in FIG. 2 with one of each of the two crown star facets and one of each of the two crown half facets on each main crown facet forming a common edge 6 on one side of a main crown facet mcf and with the other one of each of two crown star facets and the other one of each of the two crown half facets on each main crown facet forming a common edge 8 on the other side of each main crown facet mcf in a symmetrical arrangement around the diamond 10. It should be noted that this facet arrangement is unique to a hexagon shaped diamond and is believed to be important to yield a hearts and arrows pattern. The twelve crown star facets csf's and the twelve crown half facets chf's constitute 24 subsidiary crown facets.

Figure 5:
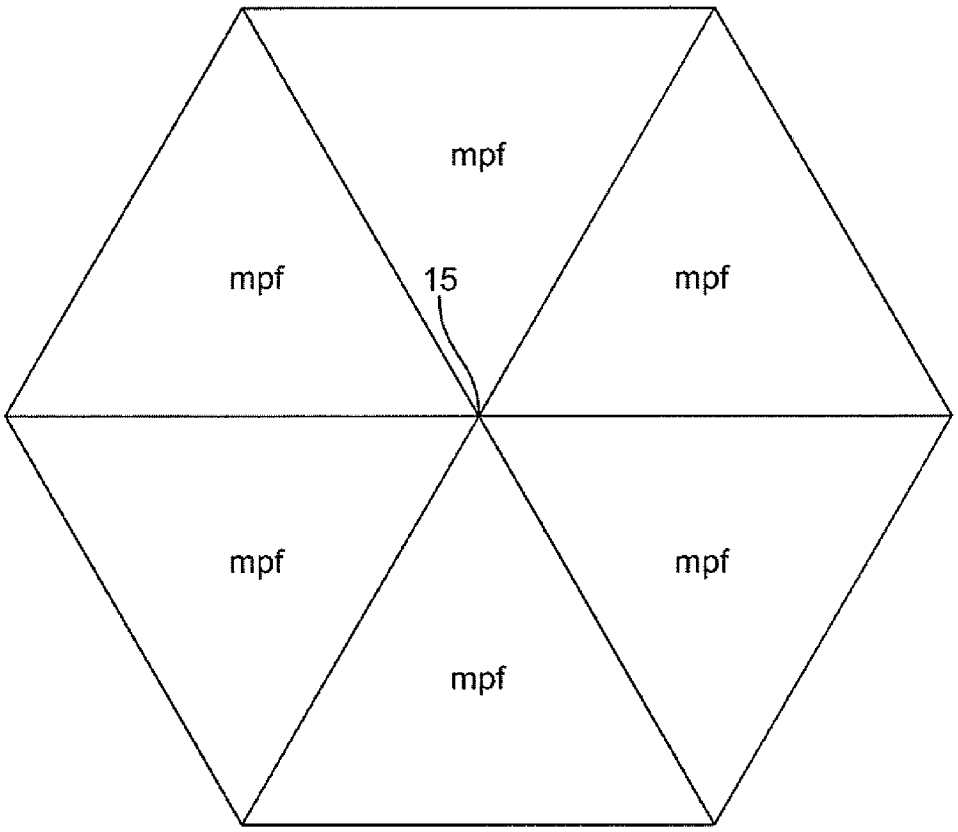
FIG. 5 is a pavilion view of the of the hexagonal shaped diamond of the present invention showing the six main pavilion facets symmetrically arranged about the center or cutlet of the diamond.
Figure 6:
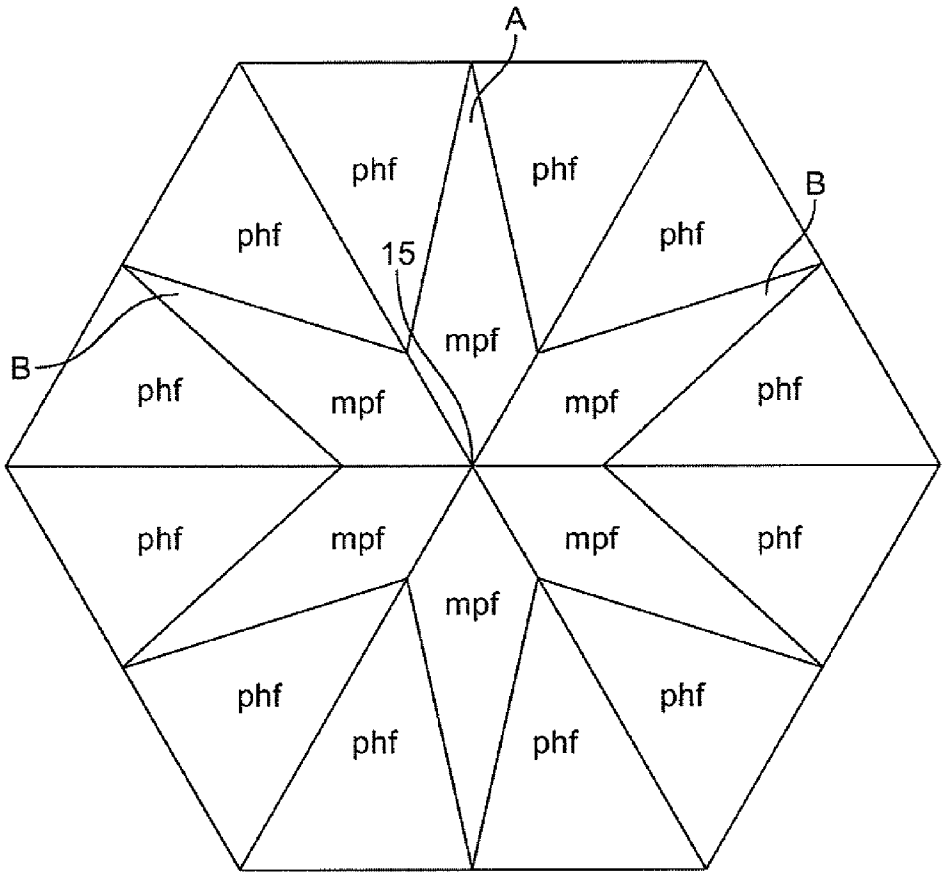
FIG. 6 is another pavilion view of the of the hexagonal shaped diamond of the present invention showing the twelve pavilion half facets arranged about the six main pavilion facets.

The six main pavilion facets mpf's are formed on the pavilion or bottom side of the diamond 10 with each main pavilion facet mpf having a triangular shape as shown in FIG. 5 and each being substantially identical in size. All six of the main pavilion facets mpf's extend from a common point located at the center or cutlet 15 of the diamond. The main pavilion facets mpf's are all polished in alignment to the main crown facets mcf's and to the girdle facets gf's and are preferably polished at an angle degree range between 40.6° and 41.1° as shown in FIG. 5. In addition to the six main pavilion facets mpf's the hexagonal shaped diamond 10 has twelve pavilion half facets ("phf's") as shown in FIG. 6 also of triangular geometry with two of the pavilion half facets phf's formed on each main pavilion facet mpf in a symmetrical arrangement. Each pavilion half facet is polished at an angle degree range of between 42.0° and 42.9° and positioned at 26.25° from the neighboring pavilion half facet that sits on the same main pavilion facet A and positioned at 33.75° from the neighboring pavilion half facet that sits on the neighboring main pavilion facet B.

Figure 7:
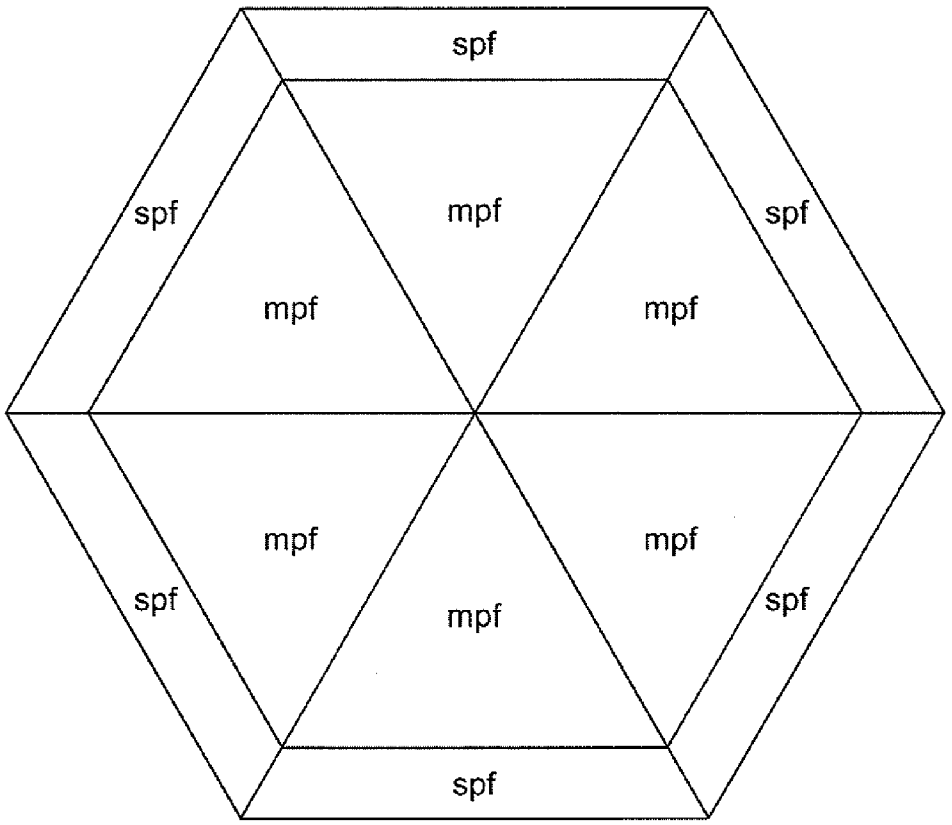
FIG. 7 is yet another pavilion view of the of the hexagonal shaped diamond of the present invention polished with subsidiary pavilion facets complementary to the main pavilion facets.
Figure 8:
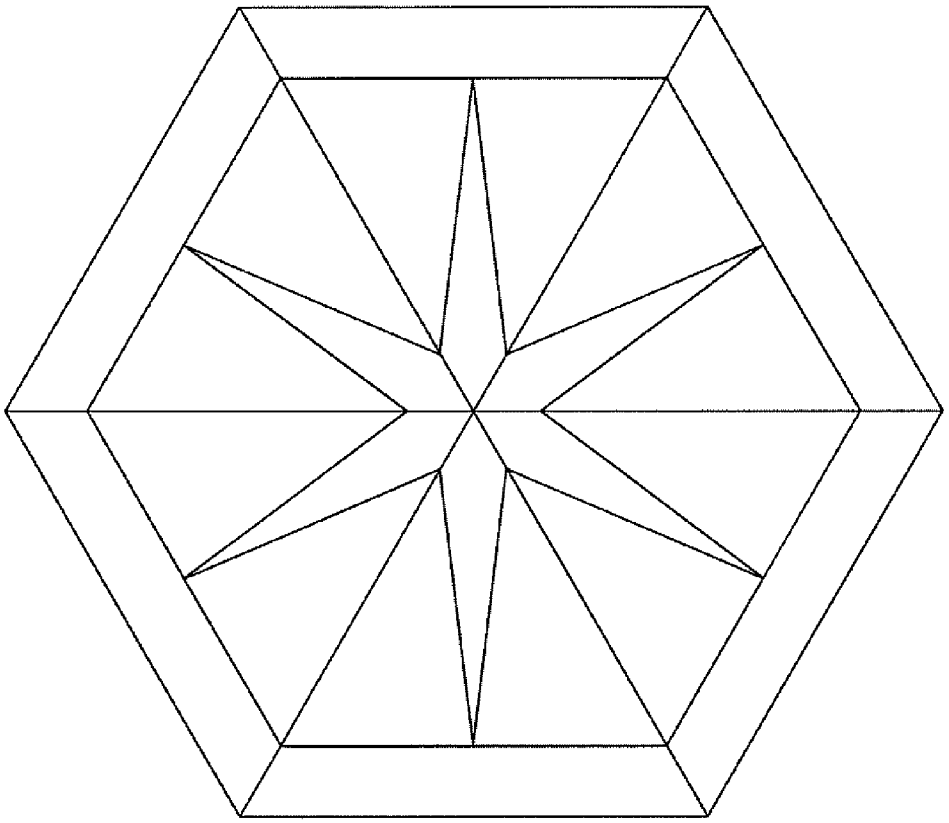
FIG. 8 is a further pavilion view similar to FIG. 7 of the of the hexagonal shaped diamond of the present invention showing the arrangement of subsidiary pavilion facets and main pavilion facets relative to the pavilion half facets.
Figure 9:
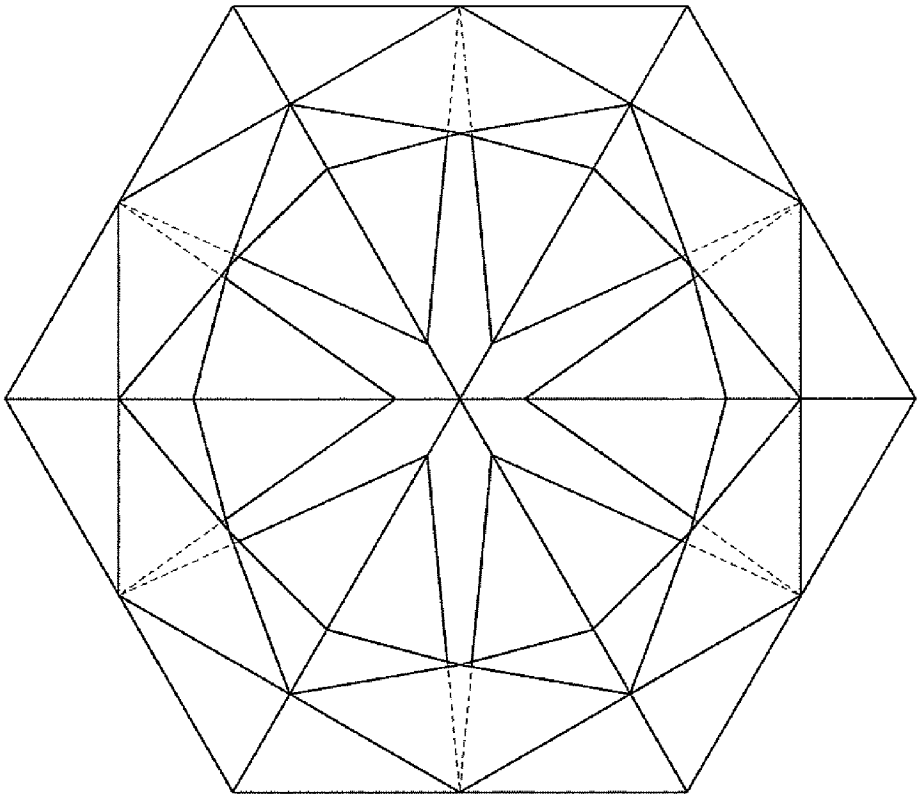
FIG. 9 is a top view of the hexagonal shaped diamond of the present invention showing the crown facets and underlying pavilion facets arranged relative to the main crown facets, crown half facets and crown star facets respectively.

The hexagonal shaped diamond of the present invention may also include subsidiary pavilion facets ("spf's") although this is optional. Subsidiary pavilion facets spf's are desired when the rough diamond used to manufacture the hexagonal shape is thick. In such case the preferred number of subsidiary pavilion facets spf is six with one subsidiary pavilion facet spf formed on each main pavilion facet as shown in FIG. 7 and preferably at an angle degree range of 65°-75°. The six subsidiary pavilion facets spf's should all be of equal size, angle degree and depth. FIG. 8 is a view similar to FIG. 7 showing the arrangement of subsidiary pavilion facets and main pavilion facets relative to the pavilion half facets and FIG. 9 is another top view of the hexagonal shaped diamond of the present invention showing all of the crown facets and the underlying pavilion facets arranged relative to the main crown facets, crown half facets and crown star facets respectively.

To produce a hexagonal shaped diamond possessing a true hearts and arrows pattern equivalent to the hearts and arrows pattern of the round cut, the diamond should be cut to satisfy the optimum parameters as set forth below in Table I:

TABLE I

| | |
|---|---|
| Total Depth: | 56.4%-66.8% |
| Table size | 53.4%-63.2% |
| Pavilion Depth | 41.2%-52.4% |
| Crown Height | 11.4%-16.8% |
| Crown angle | 33.8%-35.2% |
| Girdle thickness | 0.6%-7.5% |

Angle degree discrepancy between all main facets has to be less than 0.5° and between all star crown and half facets less than 0.7°. The main facets should all be perfectly equal in terms of the angle degree used and size and depth and at an angle tolerance of 0.4°.

The main pavilion facets should be polished with perfect alignment to the main crown facets and main girdle facets with two pavilion half facets situated on the same main pavilion facet and polished at 26.25° from each other relative to the same main pavilion facet with precisely identical heights and angle degrees.

What is claimed is:

1. A hexagonal shaped diamond, adapted to display a hearts and arrows pattern when exposed to light comparable to the hearts and arrows pattern in a round diamond, having only six main crown facets of substantially equal size symmetrically arranged relative to one another surrounding a table facet with each main crown facet having parallel edges symmetrically aligned to the parallel edges of a main crown facet located opposite thereto, six main pavilion facets polished in alignment with the main crown facets, six equal size girdle facets separating the pavilion facets from the main crown facets, and further comprising twelve crown star facets arranged about the table and an equal number of twelve crown half facets polished in an arrangement relative to the crown star facets such that there are two crown star facets and two crown half facets polished on each main crown facet with one of each of said two crown star facets and one of each of said two crown half facets on each main crown facet forming an edge on one side of a main crown facet which is in alignment and intersects the other at a common point and with the other one of each of the two crown star facets and the other one of each of the two crown half facets forming an edge on the opposite side of the main crown facet which is in alignment and intersects the other at a common point and wherein said diamond further comprises a total of twelve pavilion half facets of triangular geometry with two of the pavilion half facets formed on each main pavilion facet in a symmetrical arrangement and wherein the six equal size girdle facets are polished to form an angle of 60° relative to the girdle facet on each adjacent side thereof.

2. A hexagonal shaped diamond as defined in claim 1 wherein the main crown facets are polished so that each forms an included angle within a degree range of between 33.8°-35.2° relative to the table facet and with an angle tolerance of 0.4°.

3. A hexagonal shaped diamond as defined in claim 1 wherein the other one of each of the two crown half facets on each main crown facet form a common edge on the other side of each main crown facet in a symmetrical arrangement around the diamond.

4. A hexagonal shaped diamond as defined in claim 3 wherein the six main pavilion facets are formed on the pavilion or bottom side of the diamond with each main pavilion facet having a triangular shape of substantially equal size.

5. A hexagonal shaped diamond as defined in claim 4 wherein the six main pavilion facets extend from a common point located at the center or cutlet of the diamond.

6. A hexagonal shaped diamond as defined in claim 5 wherein the six main pavilion facets are polished so that each forms an included angle relative to a horizontal plane through the diamond when the table facet is aligned with the horizontal within a range of between 40.6° and 41.1°.

7. A hexagonal shaped diamond as defined in claim 1 wherein, each pavilion half facet is polished so that each forms an included angle relative to a horizontal plane through the diamond when the table facet is aligned with the horizontal in a range of between 42.0° and 42.9° and positioned at 26.25° from the neighboring pavilion half facet that sits on the same main pavilion facet.

* * * * *